US011553752B2

(12) United States Patent
Eiler et al.

(10) Patent No.: US 11,553,752 B2
(45) Date of Patent: Jan. 17, 2023

(54) SAFETY HELMET WITH INTERCHANGEABLE LAYERS

(71) Applicants: Ryan C. Eiler, Washington, DC (US); Peter J. Eiler, Holland, PA (US)

(72) Inventors: Ryan C. Eiler, Washington, DC (US); Peter J. Eiler, Holland, PA (US)

( * ) Notice: Subject to any disclaimer, the term of this patent is extended or adjusted under 35 U.S.C. 154(b) by 540 days.

(21) Appl. No.: 15/823,749

(22) Filed: Nov. 28, 2017

(65) Prior Publication Data

US 2019/0021434 A1 Jan. 24, 2019

Related U.S. Application Data

(60) Provisional application No. 62/535,016, filed on Jul. 20, 2017.

(51) Int. Cl.

| | |
|---|---|
| ***A42B 3/00*** | (2006.01) |
| ***A42B 3/32*** | (2006.01) |
| ***A42B 3/06*** | (2006.01) |
| ***A42B 3/12*** | (2006.01) |

(52) U.S. Cl.

CPC ..... *A42B 3/324* (2013.01); *A42B 3/062* (2013.01); *A42B 3/127* (2013.01)

(58) Field of Classification Search

CPC ..... A42B 3/127; A42B 3/324; A42B 3/063

See application file for complete search history.

(56) References Cited

U.S. PATENT DOCUMENTS

| | | | | | |
|---|---|---|---|---|---|
| 2,585,937 | A * | 2/1952 | Johnson | A42B 3/14 | 2/420 |
| 3,082,427 | A * | 3/1963 | Zbikowski | A42B 3/14 | 2/416 |
| 3,153,792 | A * | 10/1964 | Marietta | A42B 3/127 | 2/414 |
| 3,555,560 | A * | 1/1971 | Rascke | A42B 3/14 | 2/418 |
| 3,609,764 | A * | 10/1971 | Morgan | A42B 3/122 | 2/414 |
| 3,872,511 | A * | 3/1975 | Nichols | A42B 3/121 | 267/114 |
| 3,909,846 | A * | 10/1975 | Zahn | A42B 3/14 | 2/416 |
| 3,994,022 | A * | 11/1976 | Villari | A42B 3/125 | 2/909 |
| 4,035,846 | A * | 7/1977 | Jencks | A42B 3/122 | 2/6.1 |
| 4,055,860 | A * | 11/1977 | King | A42B 3/14 | 2/416 |
| 4,398,306 | A * | 8/1983 | Gooding | A42B 3/16 | 24/265 R |
| 5,113,534 | A * | 5/1992 | Lane | A42B 3/145 | 2/5 |

(Continued)

*Primary Examiner* — Richale L Quinn
(74) *Attorney, Agent, or Firm* — Blank Rome LLP

(57) ABSTRACT

A modular helmet system with a removable/detachable/interchangeable exterior shell, an inner force-absorbing layer releasably connected to the rigid exterior shell layer, and a multiple fastening devices associated with the shell which allow the shell to be interchanged/replaced/reconfigured at will. The shell as a single piece unit, or combinable components bear the fastening devices designed to enable rapid, secure interchange of the helmet system's layers, therefore allowing the helmet to be adapted for climatic, functional, and aesthetic preferences.

20 Claims, 14 Drawing Sheets

(56) References Cited

U.S. PATENT DOCUMENTS 5,150,479 A * 9/1992 Oleson ..... A42B 3/14 2/5
5,898,949 A * 5/1999 Barthold ..... A42B 3/10 2/5
6,081,931 A * 7/2000 Burns ..... A42B 3/14 2/416
6,202,223 B1 * 3/2001 Chartrand ..... A42B 3/127 2/410
6,317,895 B1 * 11/2001 Erth ..... A42B 3/06 2/416
6,378,140 B1 * 4/2002 Abraham ..... A42B 3/064 2/463
6,389,607 B1 * 5/2002 Wood ..... A42B 3/00 2/425
6,493,881 B1 * 12/2002 Picotte ..... A42B 3/121 2/413
8,091,148 B2 * 1/2012 Ho ..... A42B 3/04 2/412
8,201,269 B2 * 6/2012 Maddux ..... A42B 3/18 2/9
8,875,318 B2 * 11/2014 Huh ..... A61B 90/35 2/416
9,131,744 B2 * 9/2015 Erb ..... A42B 3/128
9,326,560 B2 * 5/2016 Lanez ..... A42B 3/14
9,516,910 B2 * 12/2016 Szalkowski ..... A42B 3/127
9,554,610 B2 * 1/2017 Sugerman ..... A42B 3/145
9,572,390 B1 * 2/2017 Simpson ..... A42B 3/128
9,642,410 B2 * 5/2017 Grice ..... A42B 3/064
9,713,355 B2 * 7/2017 Daoust ..... A42B 3/04
9,949,522 B2 * 4/2018 Ketterer ..... A42B 3/324
9,986,779 B2 * 6/2018 Pritz ..... A42B 3/127
10,244,811 B2 * 4/2019 Xiong ..... A42B 3/085
10,285,466 B2 * 5/2019 Princip ..... A42B 3/06
10,477,909 B2 * 11/2019 Laperriere ..... A42B 3/324
10,806,203 B2 * 10/2020 Grice ..... A42B 3/064
10,893,717 B2 * 1/2021 Pomering ..... A42B 3/064
2007/0277290 A1 * 12/2007 Shapiro ..... A41F 17/02 2/232
2009/0158506 A1 * 6/2009 Thompson ..... A42B 3/324 2/422
2011/0197407 A1 * 8/2011 McCabe ..... F16B 21/075 24/700
2012/0117768 A1 * 5/2012 Ramsauer ..... F16B 19/109 24/606
2012/0304366 A1 * 12/2012 Daoust ..... A42B 3/127 2/411
2013/0014313 A1 * 1/2013 Erb ..... A42B 3/122 2/410
2013/0025094 A1 * 1/2013 Ramsauer ..... E05B 9/084 24/594.11
2013/0074296 A1 * 3/2013 Richardson ..... F16B 21/073 24/634
2013/0125296 A1 * 5/2013 Rabinovitch ..... A42B 3/046 2/413
2013/0333100 A1 * 12/2013 Erb ..... A42B 3/124 2/425
2014/0068841 A1 * 3/2014 Brown ..... A42B 3/122 2/413
2014/0096311 A1 * 4/2014 Halldin ..... A42B 3/12 2/411
2014/0109297 A1 * 4/2014 Lanez ..... A42B 3/04 2/411
2014/0223641 A1 * 8/2014 Henderson ..... A42B 3/065 2/411
2015/0059066 A1 * 3/2015 Ketterer ..... A42B 3/324 2/418
2019/0166946 A1 * 6/2019 Vito ..... A42B 3/127

* cited by examiner

SAFETY HELMET WITH INTERCHANGEABLE LAYERS

PRIORITY CLAIM

This application claims the benefit of U.S. Provisional patent application No. 62/535,016, filed on Nov. 28, 2017, the contents of which are incorporated by reference.

TECHNICAL FIELD

This invention is directed to safety or recreational protective helmet system, and more particularly one or more embodiments which are directed to modular helmets comprising interchangeable exterior shell features.

BACKGROUND OF THE INVENTION

Helmets and other types of protective headwear have become increasingly popular in recent years, as the long-term implications of even minor instances of head trauma have become better understood. Early designs for protective helmets were simple and narrowly focused on maximizing impact protection. Newer designs have evolved to include more sophisticated shapes and features, but the technological improvements offered to consumers have been largely insubstantial. The incorporation of adjustable features has been mostly limited to chin straps and vents, with other advancements lacking verifiable safety benefits.

A common practice in the design of modern helmets involves molding a rigid, puncture-resistant shell and permanently fastening the shell atop an inner, crushable layer designed to collapse during a substantial impact. This method can produce a safe, aesthetically attractive helmet, which may be finely tuned for a particular activity or environment.

For consumers, an optimal helmet would be safe, lightweight, properly ventilated, aesthetically pleasing, and economical. Unfortunately, most of these criteria are only available as a trade off to one another. For example, a helmet which is sufficiently ventilated often sacrifices safety by decreasing the total surface area available for impact absorption. A helmet made with durable materials for exceptional crash protection will often be uncomfortably cumbersome, poorly ventilated, and prohibitively expensive.

Some helmet designs allow the outer shell of the helmet to be removed. A fastening mechanism may be included for fastening the shell but is exposed to direct impact. The helmet system described below provides a fastening mechanism that is protected.

SUMMARY OF THE INVENTION

The present invention provides an apparatus and methods for fabricating a helmet system formed from modular helmet elements, with removable or detachable exterior shell components that would allow the user to easily adjust the helmet's configuration, or interchange an exterior shell as desired.

A further object of the present invention is to provide an improved fastening mechanism and method for a modular helmet's outer shell in which the fasteners are protected from impact forces.

As embodied and broadly described herein, the present invention provides a modular helmet system comprising a force-absorbing element having an inner surface, an outer surface, and a plurality of fastener receptacles. The helmet further includes an exteriorly arranged rigid shell having an inner surface and an outer surface. The inner surface of the rigid shell has multiple anchoring points, which are aligned with the fastener receptacles on the outer surface of the force-absorbing element. The helmet includes multiple fastening devices, such as anchors, which enable the force-absorbing element to be removably fastened to the rigid shell, and can be easily operated by the user. These anchors extend between the force-absorbing element and the rigid shell, securing them together before use. The anchors are operable from the inner cavity of the helmet, and allow the wearer to quickly interchange or replace the anchored shell components.

As embodied and broadly described herein, the present invention further provides a method for constructing a modular helmet. This method includes first providing a force-absorbing element with a plurality of fastener receptacles to facilitate assembly. Next, a rigid shell is provided and arranged as to align its anchoring points and associated anchors with the fastener receptacles of the force-absorbing element. Finally, the former layers are secured together by engaging the multiple anchors, which extend between the layers, with the receptacles. Securement of the anchors may be performed by the user in order to fasten or remove the shell layers as desired.

Various objects, features, aspects, and advantages of the present invention will become more apparent from the following detailed description of embodiments of the invention, along with the accompanying drawings in which like numerals represent like components.

DETAILED DESCRIPTION OF THE INVENTIVE EMBODIMENTS

Known protective helmets are engineered to protect the user during the performance of a specific activity, and as a result cannot be readily adapted to changing environmental conditions or the varying preferences of the user. It remained for the present inventor to recognize that making certain components of the helmet interchangeable would provide numerous benefits, including increased performance, added user comfort, versatility, and protection. The present inventor further recognized that a helmet's adaptability could be improved through the design of specific fasteners and methods that allow the helmet's shell to be both secure and easily detachable.

Figure 1:
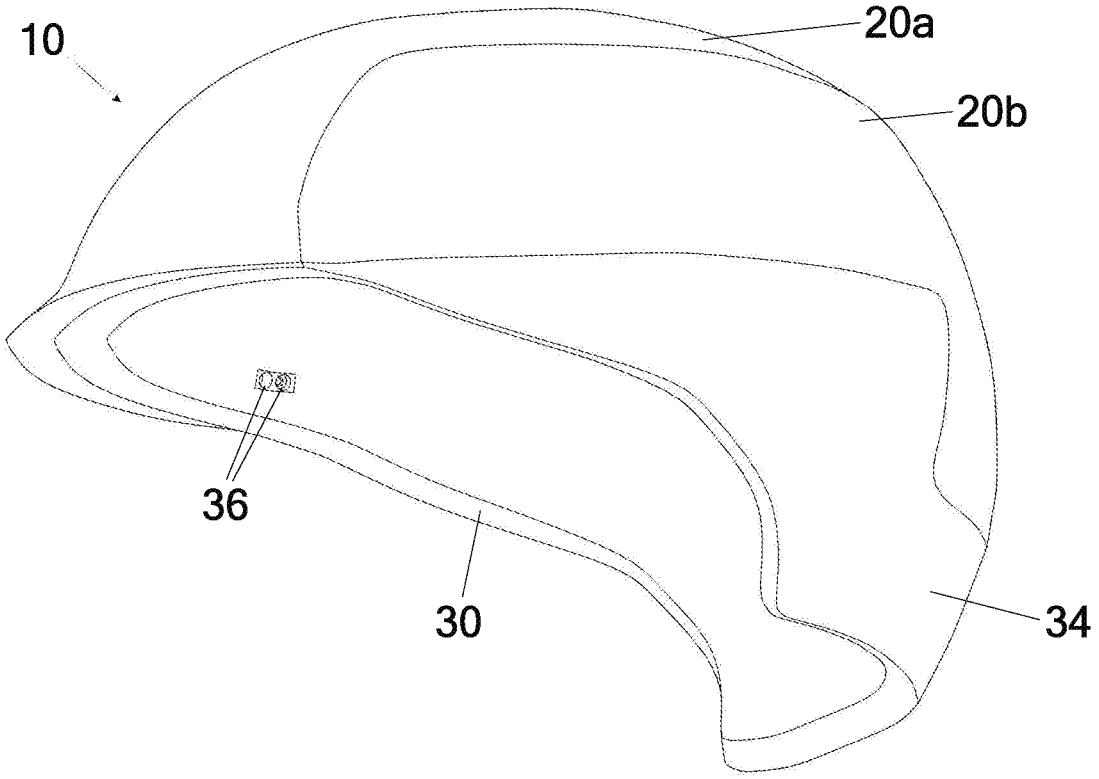
FIG. 1 is a left perspective view of a helmet according to one embodiment of the invention.
Figure 2:
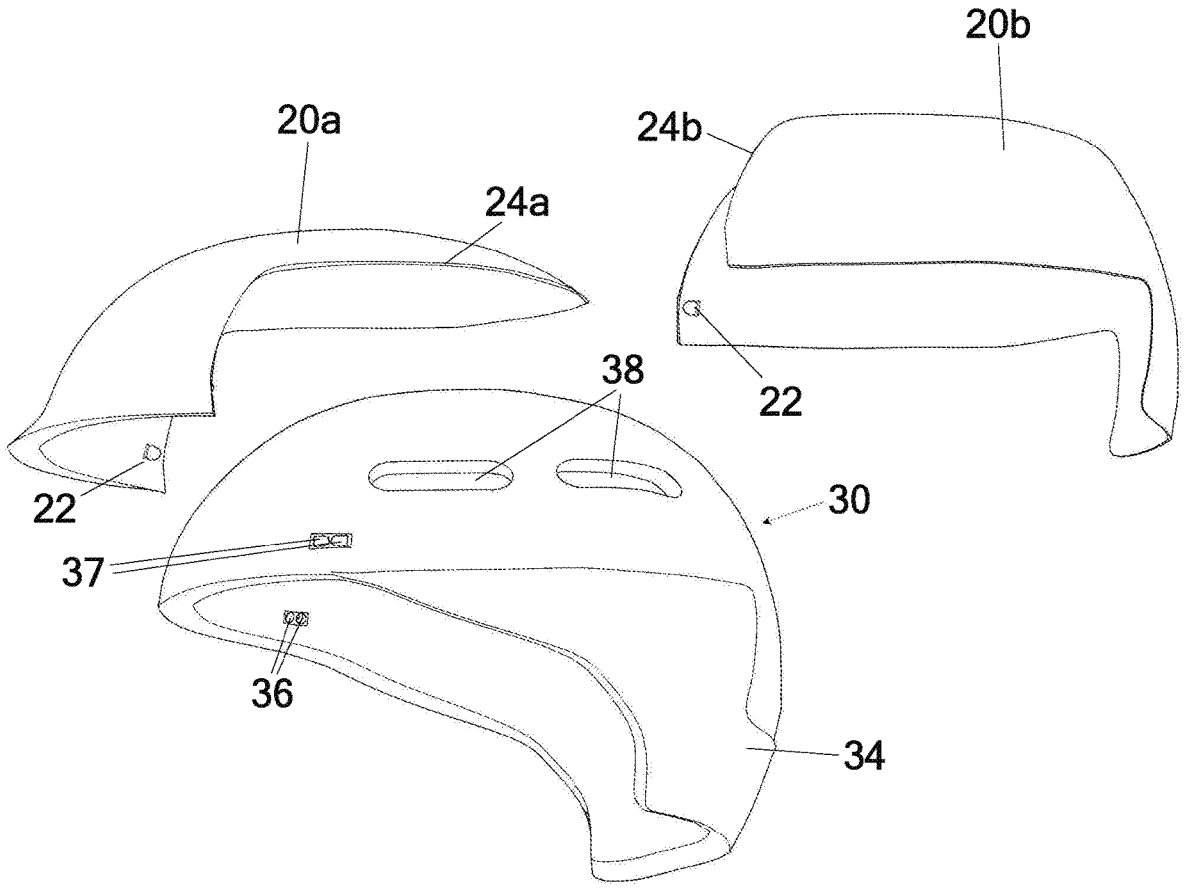
FIG. 2 is an exploded left perspective view of the helmet shown in FIG. 1, illustrating the interconnection of the rigid shell and force-absorbing element of the invention.
Figure 3:
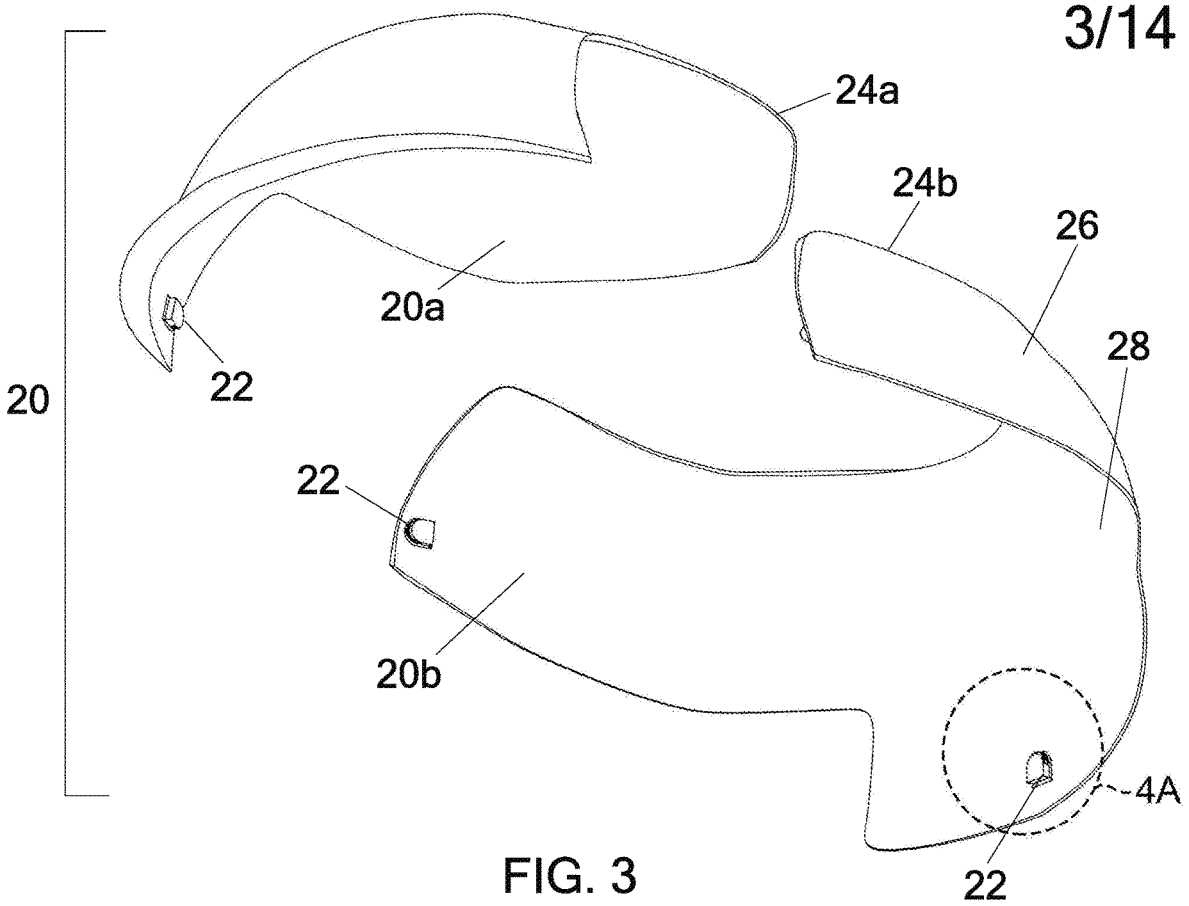
FIG. 3 is a fragmentary, bottom left perspective view of the outer rigid shell of the helmet shown in FIG. 1.

As shown in FIGS. 1-3, a protective helmet 10 in accordance with the present invention, has an outer rigid shell 20, including segments 20*a* and 20*b*, and an inner, force-absorbing layer 30, which accommodates the wearer's head, and may be adjustable. The inner force-absorbing layer 30 is positioned within the rigid shell 20 to dissipate forces applied against the shell, thereby protecting the wearer's head.

The outer shell is secured to the force-absorbing layer by one or more fastening devices 40 that are located at predefined attachment points 22 on the inner surface 28 of the shell 20, or segments 20*a* and 20*b*. Although two attachment points 22 are illustrated, multiple contact points 22 on each of segments 20*a* and 20*b*, adjacent or along shared edges 24*a* and 24*b*, are contemplated, e.g., at various intervals and stress points. As illustrated, the helmet 10 is configured as a skiing helmet, however, the invention can be formed as a protective helmet for any activity, such as, for example, cycling, football, hockey, lacrosse, motorsports, skate boarding, or construction.

The Rigid Shell

As shown in FIGS. 1-3, rigid shell 20 substantially covers force-absorbing layer 30, and is preferably constructed of a relatively rigid material such as a thermoplastic, a polycarbonate alloy, or a thermosetting resin. The shell 20 is of a predetermined thickness, which may be non-uniform in thickness, as to provide substantial protection against punctures or abrasions, and provide impact protection for the user, relative to the activity. According to one embodiment, the rigid shell 20 comprises a plurality of mating segments 20*a*, 20*b*, which are shaped as to substantially conform to each other along their shared edges 24*a*, 24*b*, and separately configured and designed to protect a user's head. In some embodiments, one of the shared edges 24*a*, 24*b* includes a groove configured to receive the other of the shared edges 24*a*, 24*b*. In other embodiments, the shared edges 24*a*, 24*b* are configured to be fastened together by another means. In still further alternative embodiments, the shell 20 is a one piece, rigid shell unit. Although not shown shell's exterior surface 26 of the shell 20, may comprise vent holes, recesses, screw ports, projections, or the like in order to extend the helmet's functionality.

The inner surface of the rigid shell 20 comprises a plurality of fastening devices 40 located at contact points 22, generally sets of fastening devices 40, which can be arranged along internal surfaces of the shell 20, and along or adjacent shared edges of both segments 20*a* and 20*b*. The fastening devices are designed to mate with fastener receptacles 37 associated with the force-absorbing layer 30, and which are similarly arranged as part of layer 30.

Force-Absorbing Layer

Figure 5A:
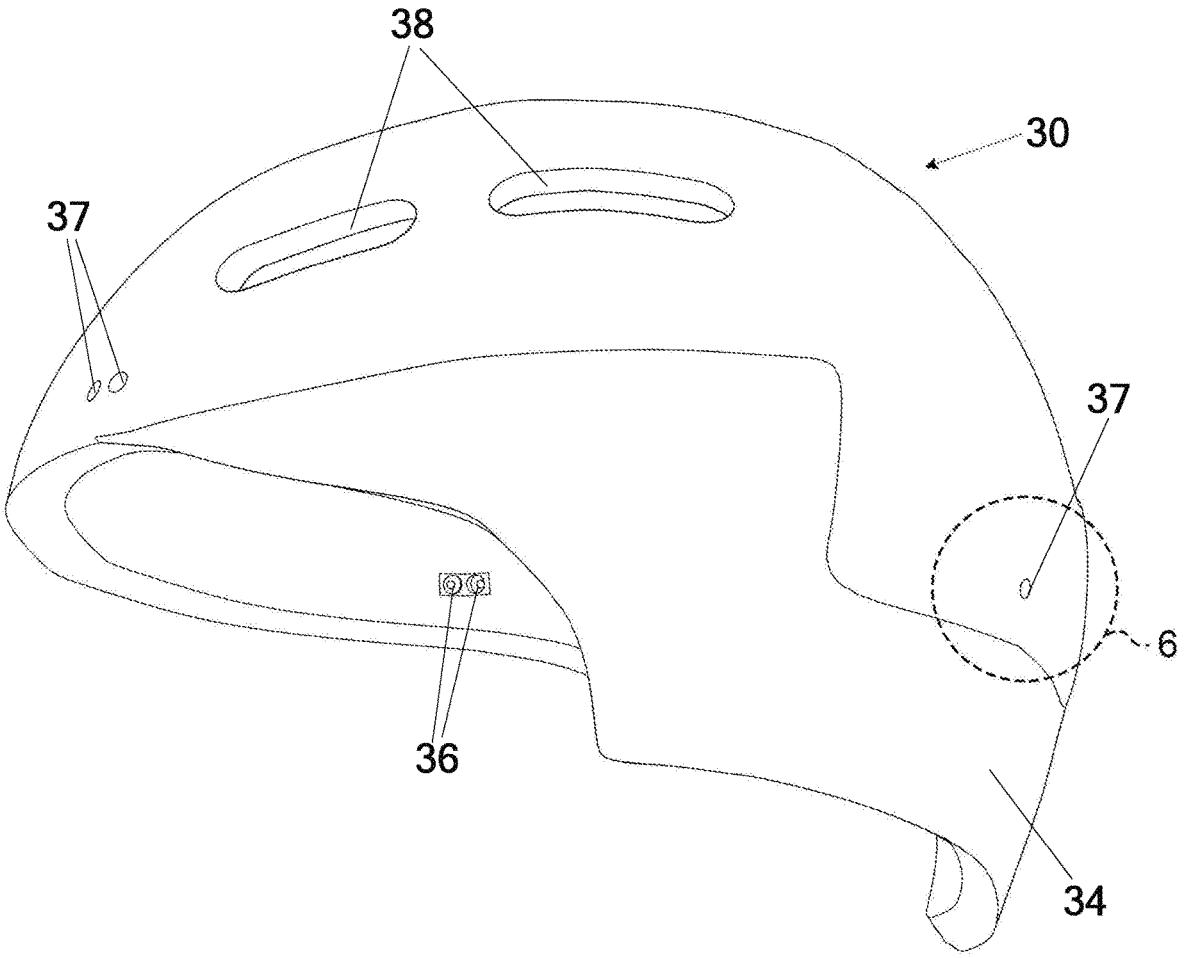
FIG. 5A is a rear left perspective view of the inner, force-absorbing element of the helmet shown in FIG. 1, illustrating the layer's fastener receptacles according to one embodiment of the invention.
Figure 5B:
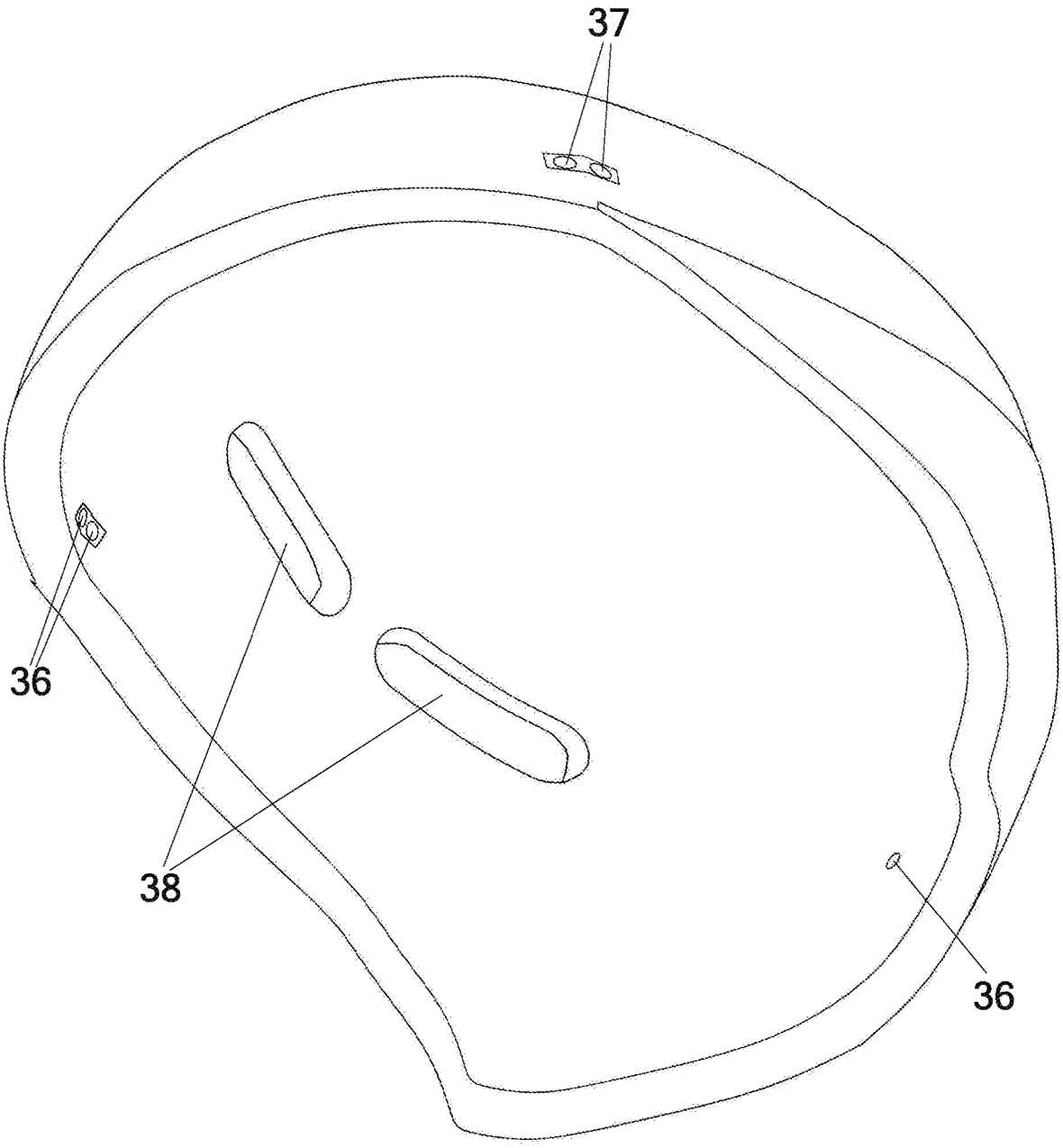
FIG. 5B is a bottom perspective view of the force-absorbing element shown in FIG. 5A.

As best shown in FIGS. 5A and 5B, the force-absorbing layer 30 includes a body having an interior surface and an outer surface. One or more orifices 36 are provided on the interior surface, and fastener receptacles 37 (FIGS. 6-11) are provided on and exposed at its outer surface, generally along its edge or peripheral surface. In addition, the force-absorbing layer may have apertures or channels 38 for ventilation purposes. In one embodiment, fastener receptacles 37 are embedded into the body of the force-absorbing layer 30. In an alternative embodiment, the fastener receptacles may be attached to a surface of the force-absorbing layer, formed as an embossment on the force-absorbing layer, or secured to an internal structure thereof. Depending on the fastening device design, the interior orifices 36 may be blind holes, offset from the fastener receptacles 37 on the exterior, or may be aligned on the same axis as the receptacles, thus forming a through hole.

The force-absorbing layer 30 may be formed from any resilient, preferably moldable, shock absorbing materials such as a foamed styrene polymer, a foamed urethane polymer or other foam-like material being light in weight and having shock absorbing properties. The shock absorbing material can also include superimposed layers of shock absorbing material having different absorbing properties. Although the force-absorbing layer 30 is substantially covered by the outer shell 20, a portion 34 of it may remain exposed if safety is not compromised.

The shell 20 substantially extends about the outer surface of the force-absorbing layer 30, and the inner side of the shell 20 has the same shape as the outer surface of the force-absorbing layer 30. While the fastening devices can be constructed from suitable materials such as metals, carbon fiber composites, nylon-type materials, plastics, plastic composites, and the like, plastic or nylon-type materials provide added protection to a wearer of the helmet.

Fastening Mechanism

Figure 9:
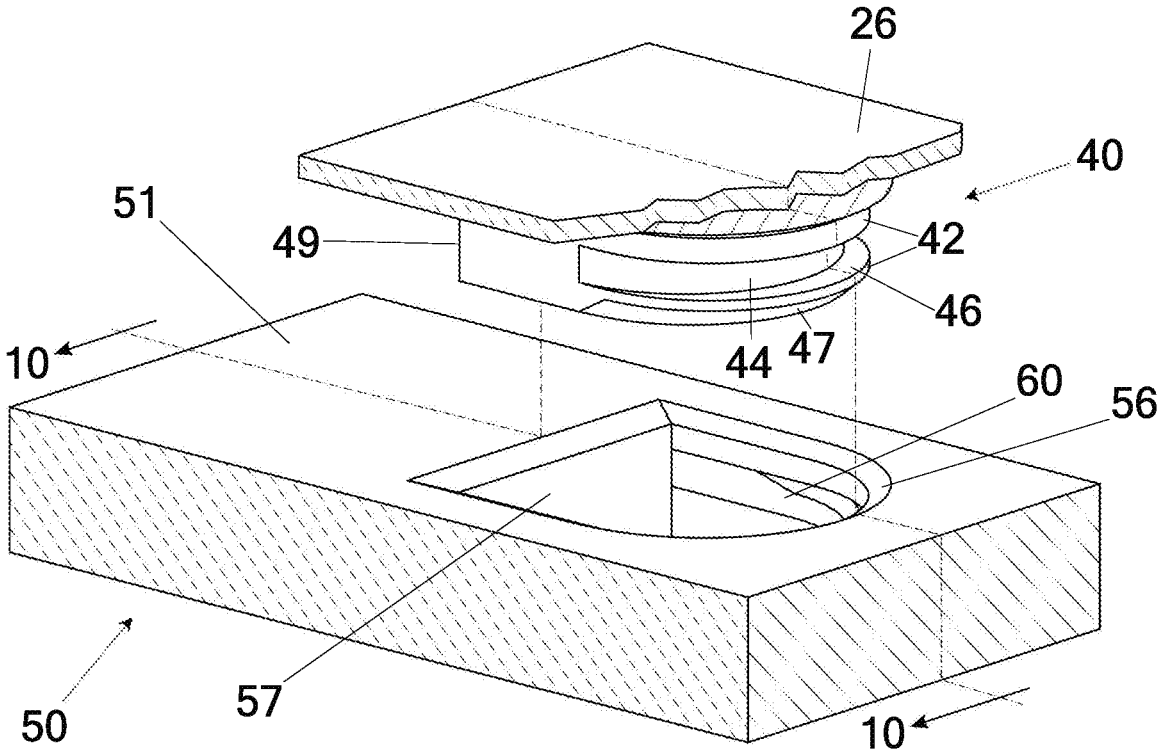
FIG. 9 is an enlarged, partial sectional view of the fastening device and fastener receptacle system, illustrating the relative position of the fastening device and receptacle prior to engagement.
Figure 10:
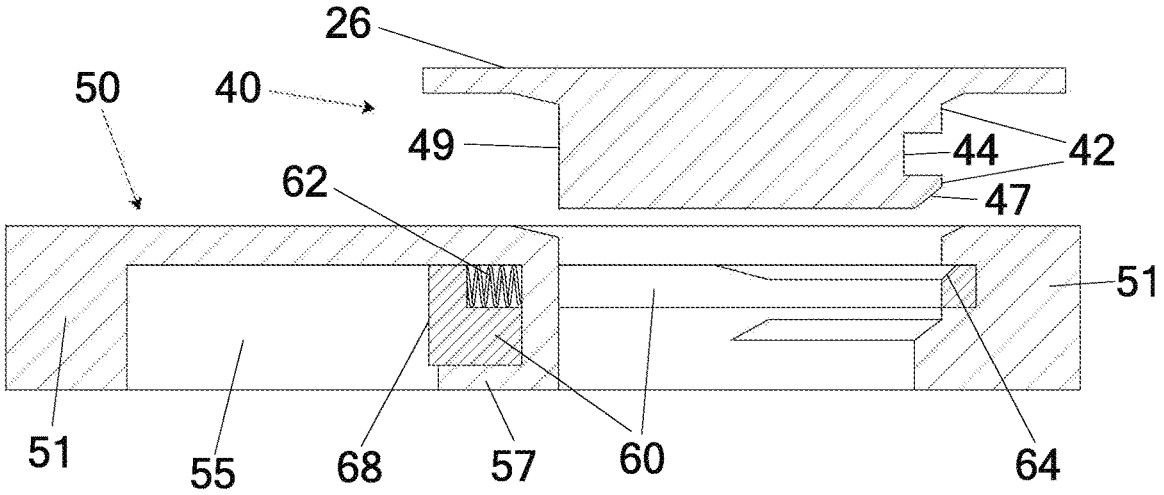
FIG. 10 is a right cross-sectional view taken along lines 10-10 of FIG. 9.

Referring to FIGS. 4A, 4B and 9-11, a fastening device 40 is depicted, and FIGS. 9 and 10 respectively show fastening device 40 in both its locked and unlocked positions. The fastening device 40 is a projection, best illustrated in FIG. 4A, and cooperates with a fastener receptacle 50, FIGS. 9-11, enabling the outer shell 20 of the helmet to be releasably secured to the inner, force-absorbing layer 30. Each fastening device 40 is located at a predetermined point 22 on the inner surface of the helmet's outer shell 20. Each fastener receptacle 50 is arranged as part of the force-absorbing layer 30 as to allow it to receive a corresponding fastening device 40 when the shell 20 is correctly aligned. The shell 20 and the force-absorbing layer 30 may have discrete, complimentary alignment members, not shown, that facilitate alignment of the shell and force absorbing layer 30.

Fasteners

Figure 4A:
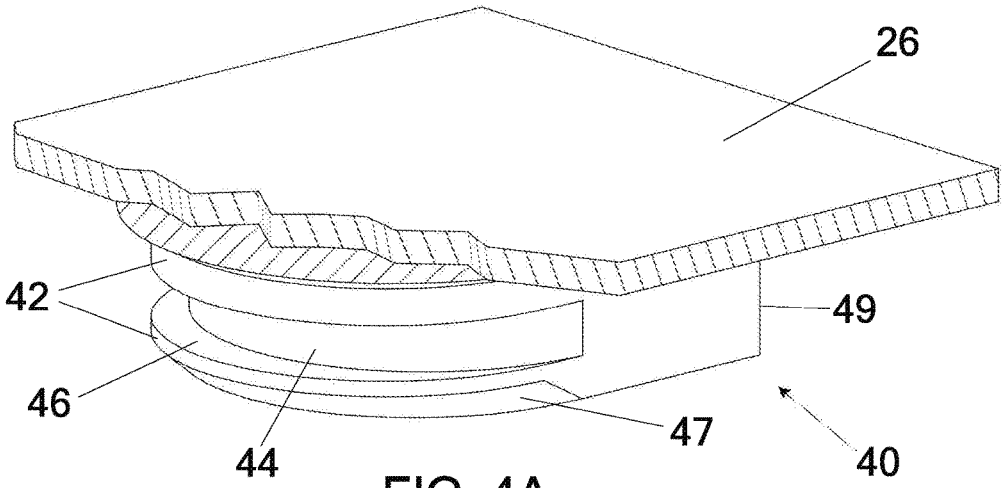
FIG. 4A is an enlarged, fragmentary view of a portion of FIG. 3, showing the outer surface of the helmet, and at least one fastening device located at one particular anchoring point on the inner surface of the helmet's rigid outer shell, according to one embodiment of the invention.
Figure 4B:
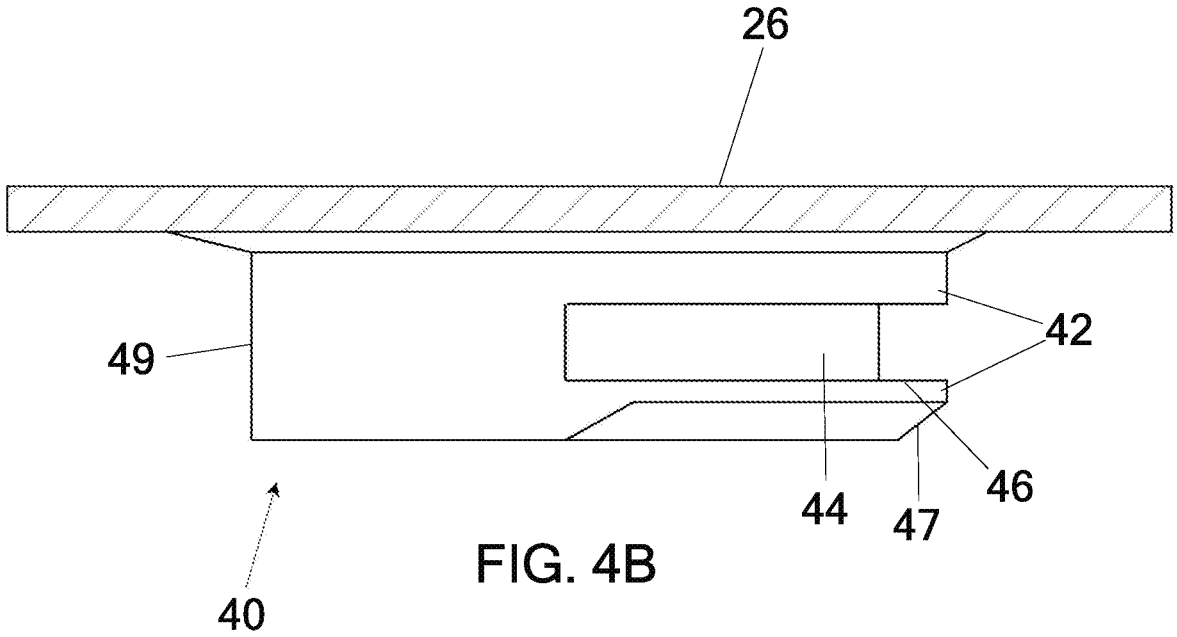
FIG. 4B is a right orthogonal view of the fastening device in accordance with the invention shown in FIG. 4A.

Referring to FIGS. 3, 4A and 4B, each fastening device 40 is attached to the inner surface 28 of the outer shell 20 at predetermined fastening points 22. The fastening devices 40 project inward, and include a projection/depending body that is substantially perpendicular to the surface 26 of the shell 20, and formed as to allow mating and locking with a corresponding fastener receptacle 50 associated with the force absorbing layer 30. The fastening devices 40 may optionally include a tensioning member (not shown), such as a flexible beam or spring, in order to urge the fastening device 40 (or a portion thereof) into a predetermined location within its corresponding fastener receptacle 50.

FIG. 4A depicts an exploded, cutaway view of one embodiment of fastening device 40, in which part of the exterior surface 26 of the shell 20 is still visible. The fastening device 40 has a substantially D-shaped cross-section with a rounded/curved side with an outer radius 42, and an opposing side formed as a flat surface 49 with squared edges. Although a D-shaped cross-section has been illustrated, other cross-sectional shapes, such as, hemispherical, semi-hexagonal, semi-octagonal, C-shape, quadrilateral, can be used consistent with locking and unlocking mechanism of the present invention.

The rounded/curved side with the outer radius 42 includes at least one groove 44. The surface of the groove 44 runs perpendicular to the shell, creating a shelf-like surface 46 which extends outward from the groove 44 and runs parallel to the exterior surface 26 of the shell 20. The shelf-like surface 46 is widest at the midpoint of the groove 44, and decreases in width toward either side of the groove 44. The outermost edge of the fastening device's rounded side 47 is chamfered at approximately 45 degrees. The shelf 46 is formed between the groove 44 and the outer radius 42. The shelf 46 projects outward from the bottom of the surface of the groove 44.

The outermost surface of the fastening device 40 is generally parallel to the surface 26 of the shell. The fastening device 40 in this embodiment is integrally molded to the helmet 10, but other embodiments include fastening devices which are chemically or mechanically attached. The upper surface connects to the inner surface of the shell 20. The fastening device 40 is relatively thin and has a layer-like arrangement, wherein the upper surface is followed by a first outer radius, then the groove 44, then a second outer radius, then the rounded side 47.

Fastener Receptacles

Figure 6:
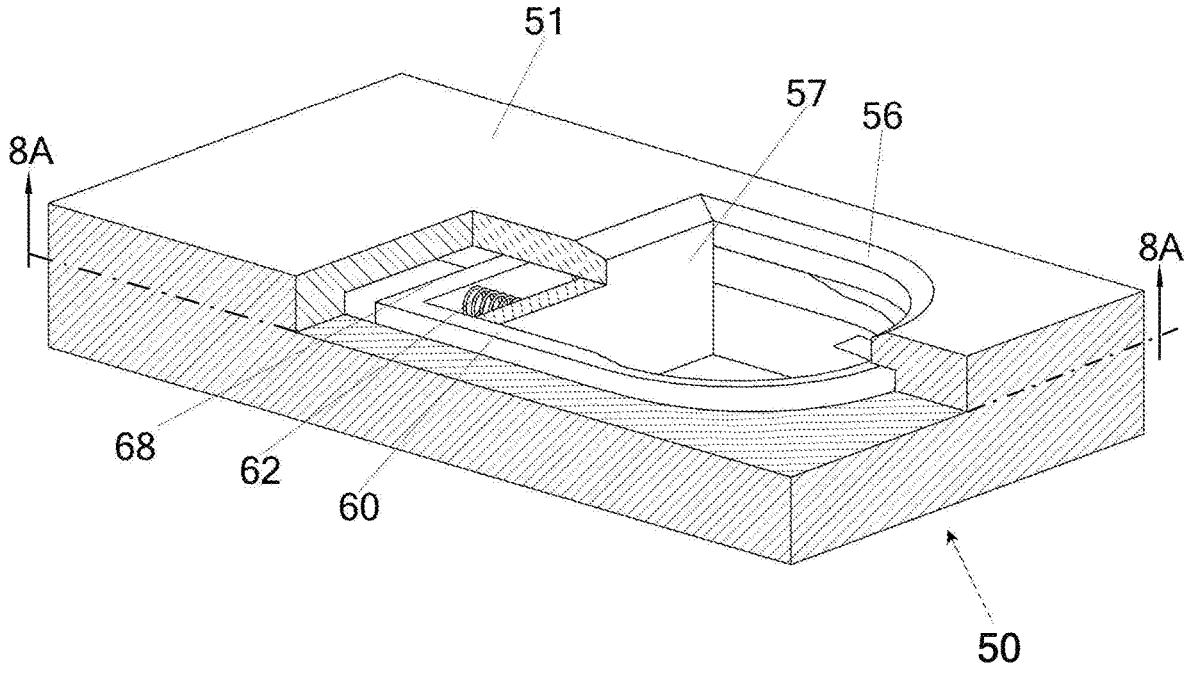
FIG. 6 is an enlarged, right elevational, fragmentary view of a fastener receptacle embedded in the force-absorbing layer, wherein a portion of the receptacle's surface is cut away to expose the internal spring-loaded mechanism.
Figure 7:
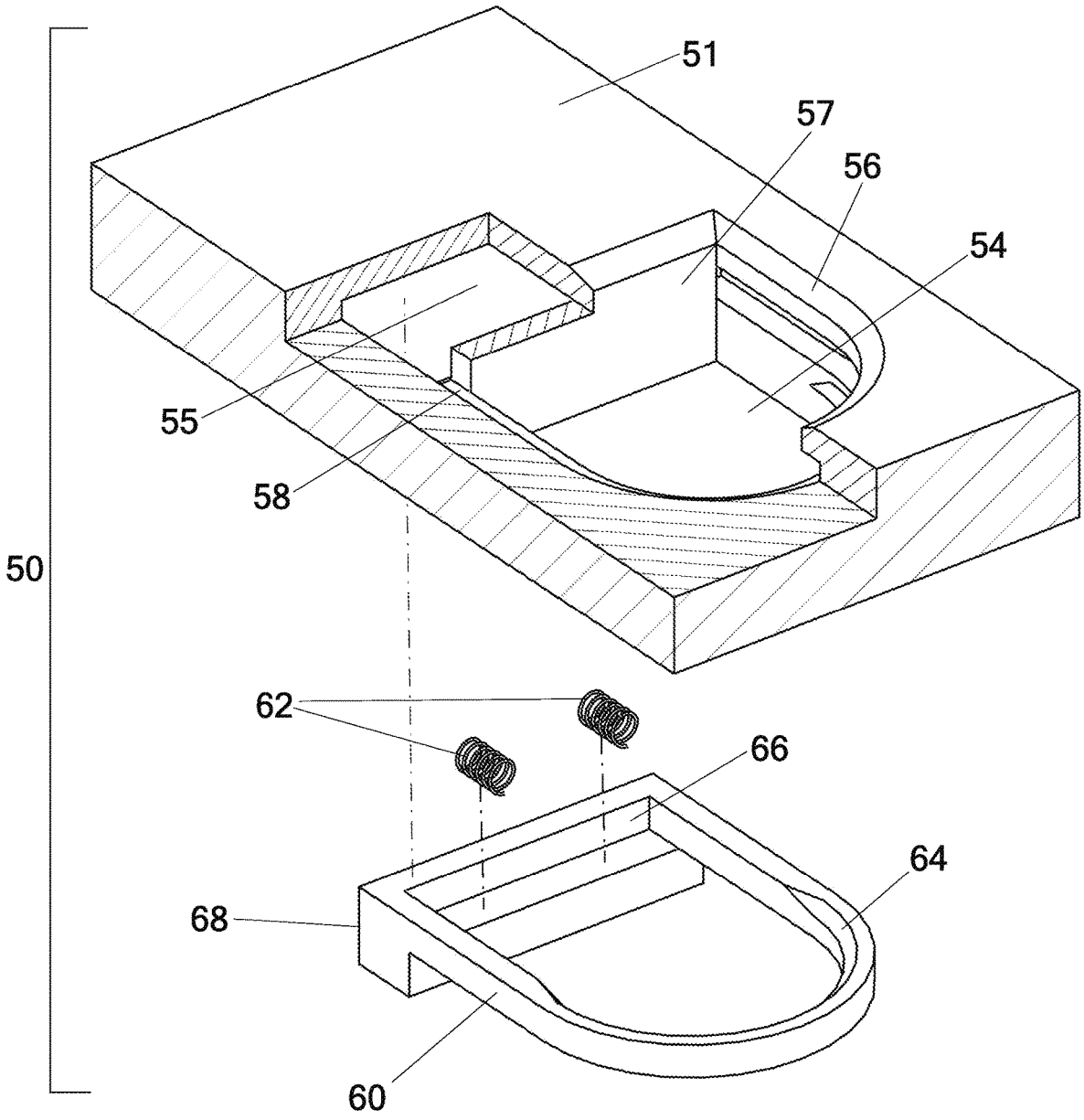
FIG. 7 is an exploded view of the fastener receptacle shown in FIG. 6.

FIGS. 6-7 illustrate a fastener receptacle 50 in accordance with one embodiment of the invention where the receptacle is shown embedded in the force-absorbing layer 30, with the force-absorbing layer and a portion of the receptacle's upper surface cut away. In the illustrated embodiment, the receptacle 50 comprises a receptacle body 51, a D-shaped lock ring 60, and at least one tensioning member, e.g., a spring 62. In some embodiments, the tensioning member may be located on the fastening device 40 rather than the receptacle 50. The overall structure of the receptacle 50 resembles a hollow, elongated rectangle with its bottom face removed. In the illustrated embodiment, it is arranged in the helmet 10 such that the upper surface of the receptacle forms a continuous surface with the exterior of the helmet's force-absorbing layer 30.

The receptacle body 51 comprises a D-shaped aperture 54 at one end, and a rectangular cavity 55 on the underside of its opposing end. The lock ring 60 is housed in a track 58 inside the receptacle body 51, allowing it to slide from a first, "locked" position to a second, "unlocked" position. The aperture of the lock ring 60 generally aligns with the opening 54 in the receptacle body 51 when in the second position. In one embodiment, a plurality of springs 62 are arranged as to exert a force between a surface of the lock ring 60 and a partition wall 57 of the anchor body, urging them apart. The springs 62 may be held in place by a channel, or any conventional attachment method, including, for example, a protuberance, a socket, welding, brazing, and gluing. The upper inside edge of the rounded section 64 of the lock ring 60 is chamfered, as is the perimeter of the upper opening 56 of the receptacle body 51. In another embodiment, only the upper surface of the receptacle body 51 is exposed on the outer surface of the force-absorbing layer 30 (e.g., force-absorbing element), however, alternate embodiments may embed the surface of the receptacle body 51 within the force absorbing layer 30.

Figure 8A:
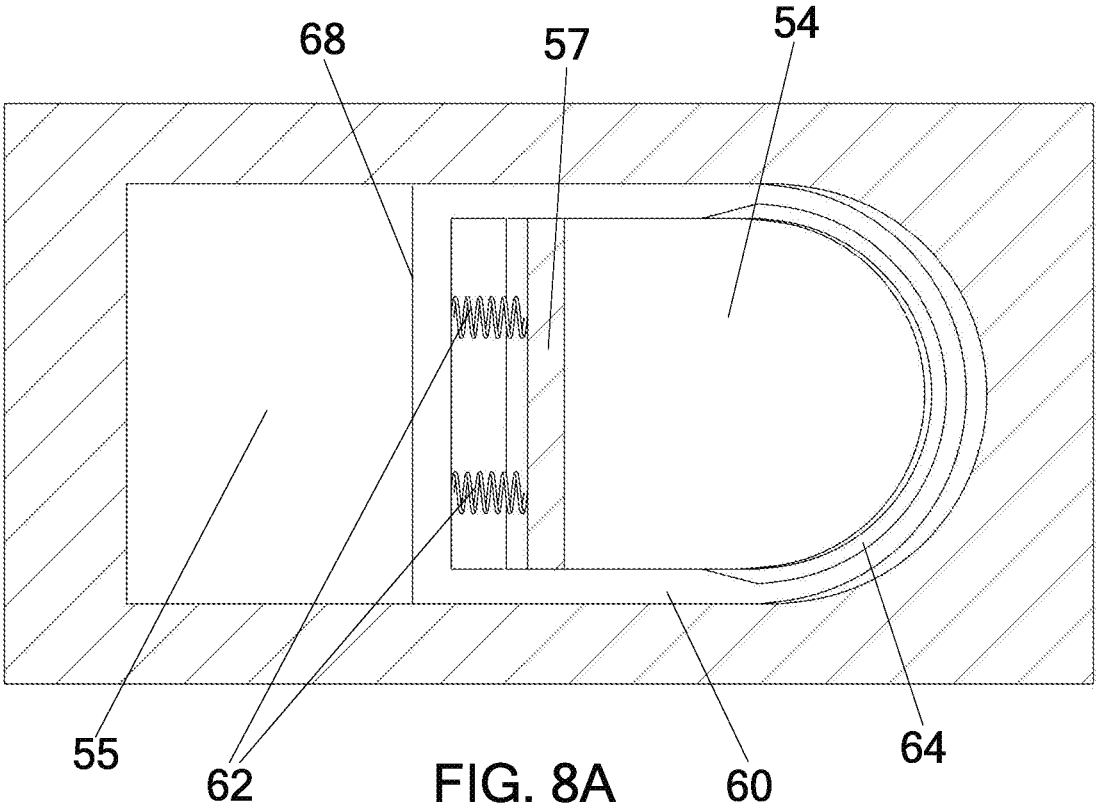
FIG. 8A is a cross-sectional view taken along lines 8A-8A of FIG. 6, in which the springs are decompressed, and the receptacle is in the locked position.
Figure 8B:
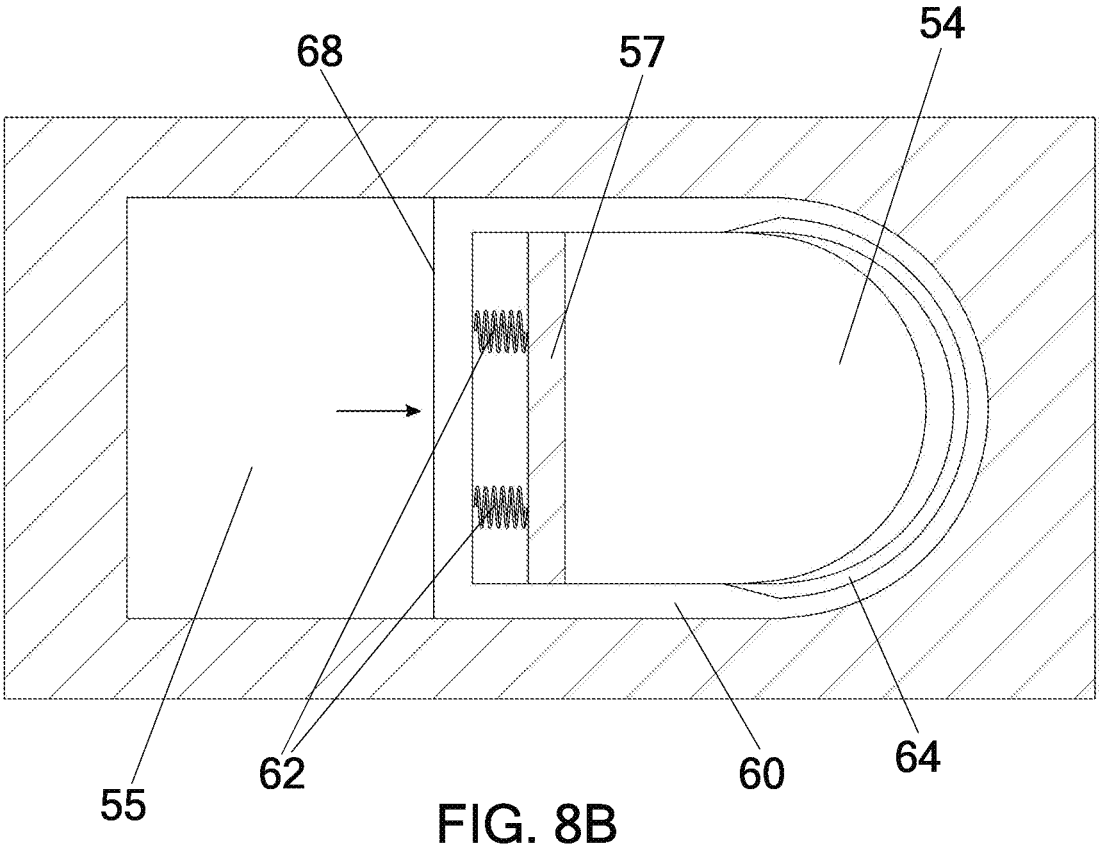
FIG. 8B is the same view as shown in FIG. 8A, with the springs compressed and the receptacle in the unlocked position.

Referring to FIG. 8A, a top orthogonal view is shown in which the top surface of the fastener receptacle body 51 is cut away to display its internal components. The springs 62 are decompressed, and the lock ring 60 is slid to its first, "locked" position. FIG. 8B depicts the same perspective as FIG. 8A, but with the lock ring 60 in its second, "unlocked" position wherein the springs 62 of the receptacle are compressed. An arrow indicates the movement of the lock ring 60 within the track of the receptacle body 51 from its first to its second position. The side of the lock ring 60 opposite the curved end is a flat rectangular face 68, and is exposed to the cavity 55 of the receptacle body 51. The cavity 55 of the receptacle body 51 may feature a ridge (not shown) in order to limit the range of movement of the lock ring 60.

Fastening devices and fastener receptacles of all embodiments are of a predetermined size as to prevent separation during the course of normal use.

Operation

Figure 11:
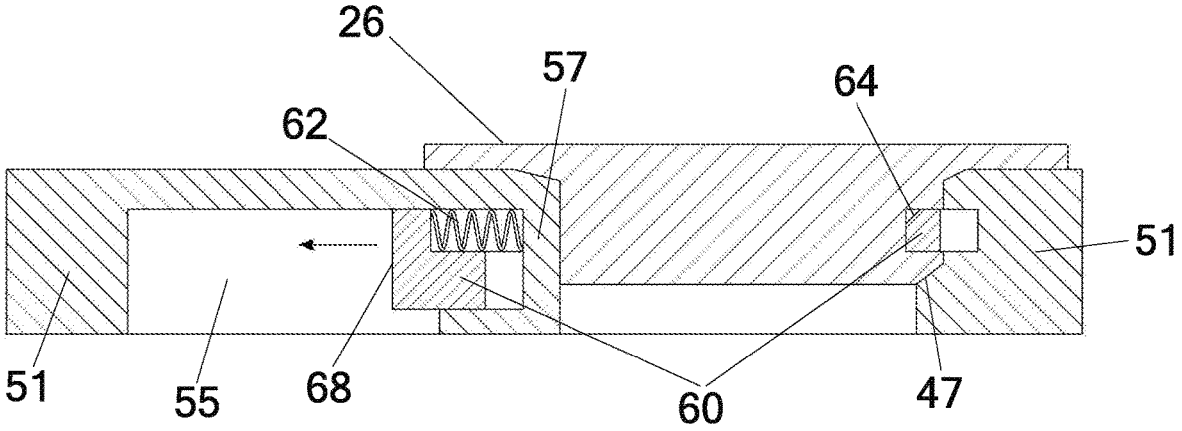
FIG. 11 shows the fastening device and receptacle system of FIG. 10 after the fastening device has been inserted and locked into the fastener receptacle.

Referring to FIGS. 2, 10, and 11, in operation of the current embodiment, helmet shell segments 20*a* and 20*b* are installed by first placing them atop force-absorbing layer 30 so that the fastening devices 40 located at their respective attachment points 22 are aligned with their corresponding fastener receptacles 37. When the rigid shell is manually compressed onto the force-absorbing layer, each fastening device is inserted into its respective fastener receptacle, and the receptacles' lock rings are initially forced open. More specifically, the chamfered surface of the rounded side 47 comes into contact with and pushes outward against the chamfered lock ring surface 64. This counteracts the force of the springs 62 and slides the lock ring 60 outward into its second, "unlocked" position within a slot or opening 52 in the receptacle body 51, as shown in FIG. 10. With the lock ring 60 in the second position, the fastening device 40 is free to slide fully into the fastener receptacle 50, allowing the inner surface of the rigid shell 20 to lie flush against the force-absorbing layer 30.

When the fastening device 40 is fully inserted in the receptacle 50, the rounded/curved side with the outer radius 42 of the lock ring 60 is aligned with the groove 44 of the fastener receptacle, enabling the springs 62 to force the lock ring back into its first, "locked" position as shown by the arrow in FIG. 11, thus lockingly engaging the fastener device 40 to the receptacle 50. In the locked position, a gap is located between the inner surface of the lock ring 60, and the partition wall 57. Also in the locked position, the rigid shell 20 is fastened to the force-absorbing layer 30, and the anchoring system will resist any shear or compressive forces exerted upon the outer layer of the rigid shell 20. The only method of releasing the fastening device 40 is to apply a force to the lock ring's exposed surface 68, compressing the receptacle's springs 62 and moving the lock ring 60 to its "unlocked" position. In this particular embodiment, this can be accomplished by the user reaching inside the inner concavity of the assembled helmet 10, placing a finger inside the receptacle's cavity 55, and pushing on the lock ring's surface 68. In the unlocked position, the fastening device is free to slide from the receptacle and allow the rigid shell to separate from the force-absorbing layer.

Since the exterior shell 20 is removable, the wearer may easily configure the helmet 10 to the climate or interchange components for aesthetic or functional reasons. Another highly important benefit comes from the fasteners 40 being unexposed to direct impact, thereby retaining the helmet's safety characteristics. The wearer is also afforded the ability to thoroughly inspect the integrity of the force-absorbing layer 30 at any time. This can prevent him or her from unwittingly relying on a compromised helmet for impact protection.

Alternative Embodiments

Figure 12:
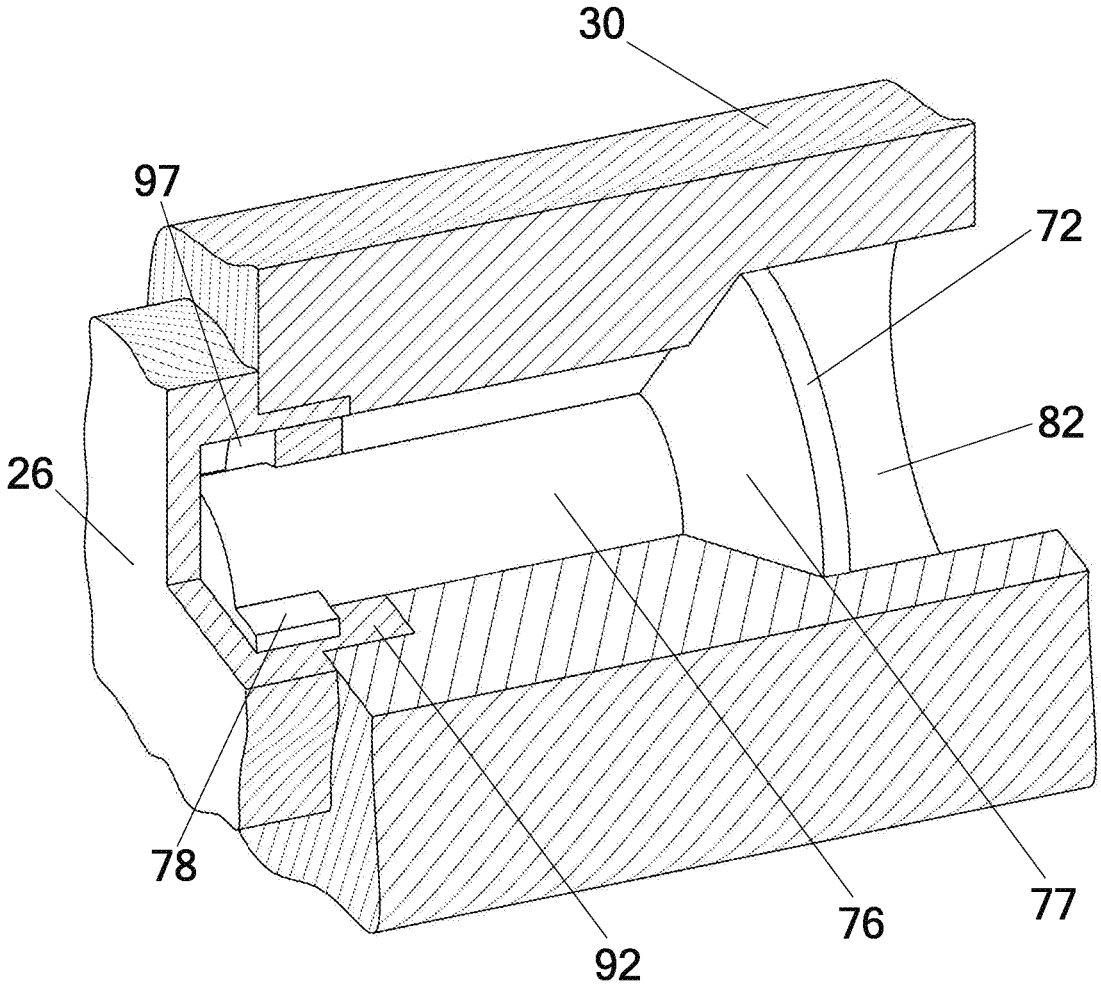
FIG. 12 is a partial sectional view of one alternative embodiment of the fastening device and receptacle system shown in FIG. 9, in which a part of each of the helmet's layers is cut away to expose the anchoring mechanism.
Figure 13:
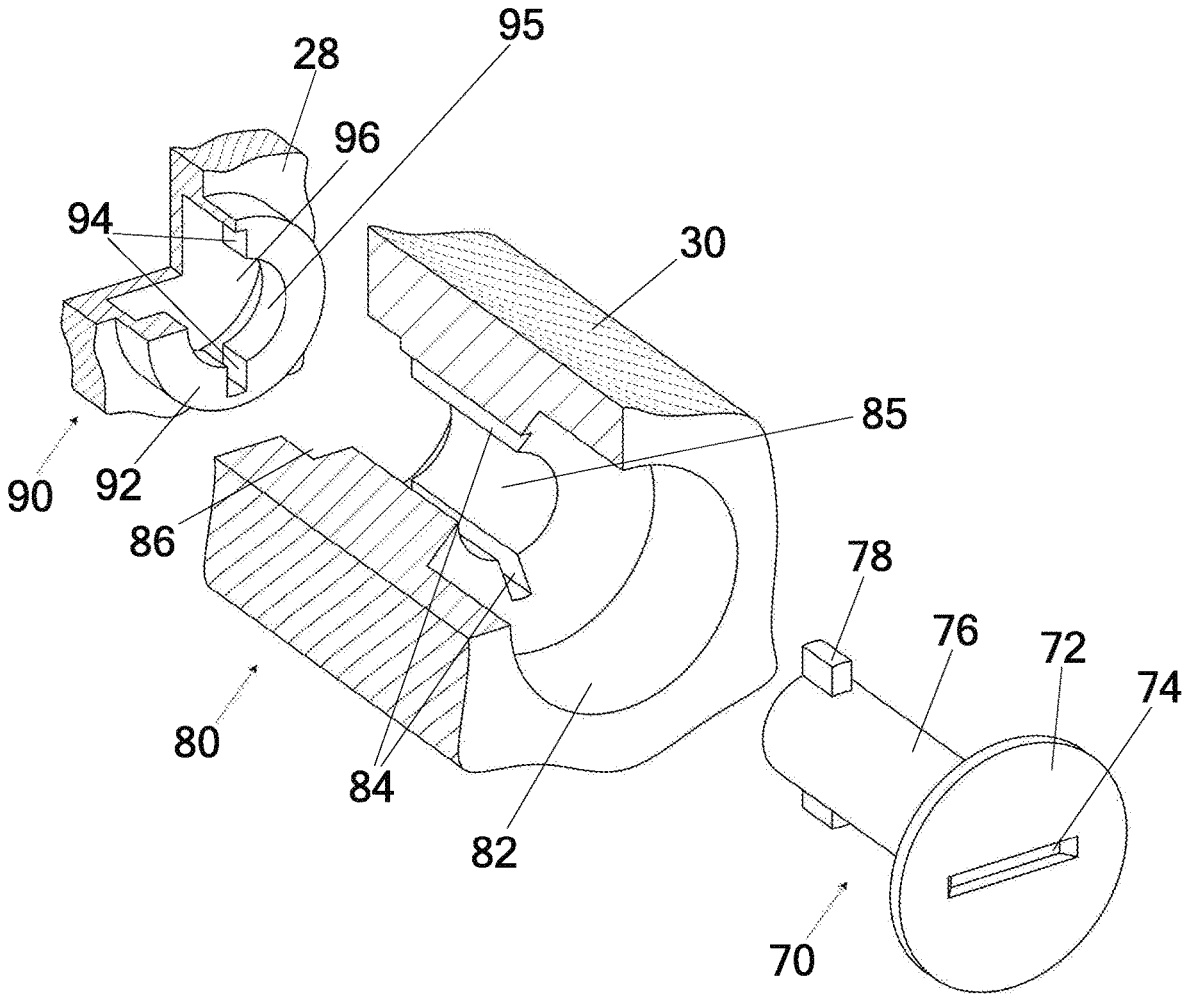
FIG. 13 is an exploded view of the anchoring system shown in FIG. 12.
Figure 14:
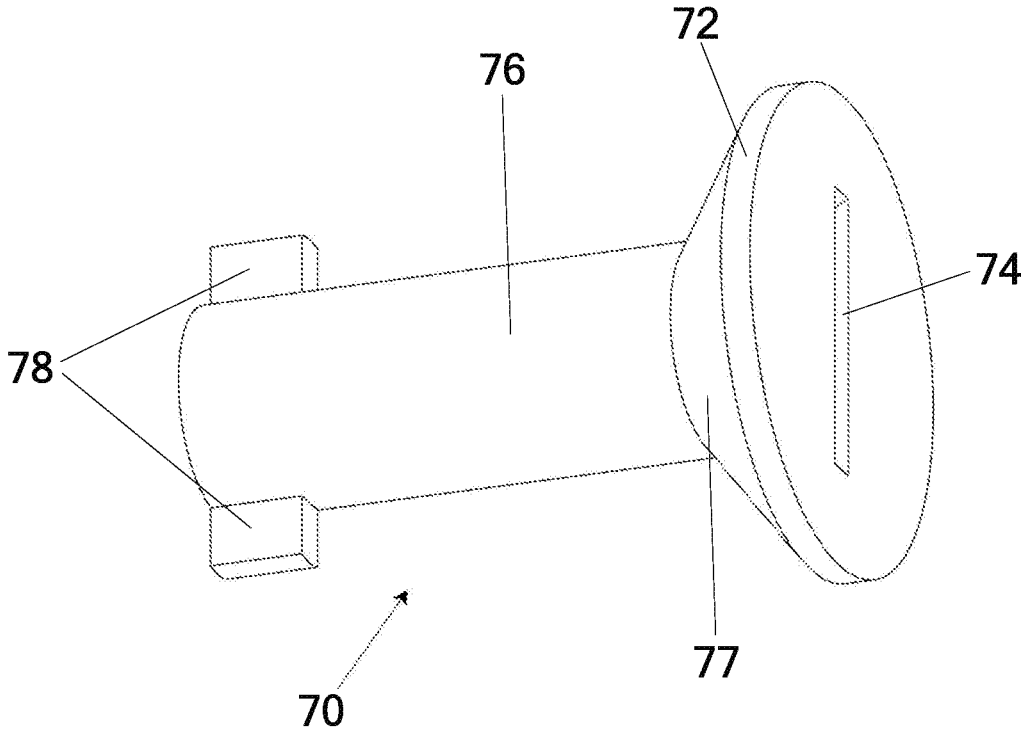
FIG. 14 is an enlarged side view of the fastening device used in the anchoring system of FIG. 12.

FIGS. 12-14 depict an alternative embodiment of a fastening mechanism, comprising an anchor 70, a fastening device 90, and a fastener receptacle 80. This design also allows quick interchange of the helmet layers, but instead relies upon an anchor to secure the layers. From the helmet's internal cavity, the user inserts the anchor 70 through the receptacle 80, into the fastening device 90 on the shell 20 of the helmet 10, and turns the anchor 70 into its locked position.

The anchor 70 in this embodiment is a quick-release type screw comprising two fins 78, a shaft 76, a tapered head 72, and a recess 74. The head of the screw 72 is substantially larger in diameter than the screw's shaft 76 and comprises an exterior surface with a recess 74 to facilitate operation, as well as an interior surface 77 that engages the bottom of the countersunk hole 82. The shaft 76 has a proximal end coupled with a distal end. One or more fins 78 project outward at the distal end of the shaft 76, in a transverse direction. The screw 70 is a single, integral piece, that when rotated by its top recess 74 (such as by using a coin, flat-head screwdriver or specialty tool) will cause the fins 78 on the distal end of the shaft to also rotate.

The fastener receptacle 80, arranged within the force-absorbing layer 30, comprises a countersunk through-hole 85, sized to receive the shaft 76 and tapered head 72 of the screw 70. The through-hole extends entirely through the force-absorbing layer 30, connecting openings 82 and 86. The through-hole diameter is slightly larger than that of the screw's shaft 76, and substantially the same diameter as the opening of its corresponding flange 92. The central axis of the through hole is aligned with the center of the corresponding fastening device's flange 92. The notches 84 formed in the through hole have dimensions just large enough to allow passage of the screw's fins 78. The notches 84 align with the notches 94 on the corresponding flange, thereby aligning the screw's fins 78 with the flange's notches 94, as well as the screw's shaft 76 with the flange's inner diameter 95. Because the relatively rigid components 20 and 30 closely conform in shape, and the fastening device 90 and receptacle 80 are attached to these components respectively, the notches 84 and 94 will naturally align themselves during use. The wider segment of the countersunk hole 82 is shaped to receive the interior surface 77 of the screw's head 72. On the outer surface of the force-absorbing layer 30, an annular recess 86 is formed. The recess allows the flange 92, and thus the outer shell 20 to lie flush against the force-absorbing layer 30. In alternate embodiments of the present invention, the anchoring system may comprise any conventional releasable fastener such as a turnlock fastener, threaded screws, bolts, rib fasteners, spring clips, and the like.

A fastening device 90 is integrally formed at each attachment point 22 on the rigid shell 20. Each fastening device 90 comprises a circular flange 92 projecting inward, toward the cavity of the helmet 10. The flange 92 has an inward lip 95 with an inner diameter slightly larger than that of corresponding screw's shaft 76, creating a locking ledge 97 for the screw's fins 78. This lip forms a cylindrical cavity 96 between the flange's lip and the rigid shell, the cavity's height being approximately the height of the screw's fins 78. Since the diameter of the flange's lip 95 is too small to receive the fins 78 of the screw, the fins 78 may only enter cavity 96 by way of notches 94

Alternative Embodiments—Operation

Referring to FIGS. 2, 12, and 13, in operation of this alternative embodiment, the helmet shell 20 is installed by first placing it atop the force-absorbing layer 30 so that the fastening devices 90 at each attachment point 22 are aligned with their corresponding fastener receptacles 37. Since both the shell 20 and the force-absorbing layer 30 of the helmet 10 conform closely in shape and are relatively rigid, and the fastening mechanism and receptacles will naturally tend to align themselves during engagement. It will be clear to the user if the fastener's flange 92 is not properly fitted into the annular recess 86 of the receptacle. The notches 94 and 84 are aligned properly during the manufacture process, and will remain aligned when the layers are properly coupled. From the inner concavity of the helmet, with the fins 78 properly aligned with the notches 84 of the receptacle, the screw 70 is inserted through the length of the through-hole 85 in the receptacle. The screw then passes into the fastening device's cavity 96. Once inserted into the flange's cavity 96, a rotational force may be applied to recess 74, thereby rotating the screw's fins 78 under the locking ledge 97 and into their locked position.

In the locked position, components 70, 80, and 90 are temporarily fastened. The fins 78 of the screw prevent its release from the fastening device, as the fins are of a wider diameter than the locking ledge 97 holding it in place. Additionally, the interior surface 77 of the screw's head 72 exerts a compressive force on the bottom of the receptacle's countersunk hole 82, forcing the receptacle against the fastening device. As the fastening device 90 is attached to the helmet shell 20, and the receptacle 80 is attached to the force-absorbing layer 30, the dynamics of the screw lock these two layers together. The installation of the screw can be undone by reversing the process. Turning the screw in the counterclockwise direction until the screw's fins 78 align with the flange's notches 94, and then pulling the shaft 76 of the screw out of the cavity 96 and through the receptacle's through hole 85, will allow the screw to be removed, and the layers of the helmet 10 to separate. Other embodiments of this screw and anchor design may vary in their specific design of the securement method, but are still within the scope of the invention.

The structure described above, of internally-accessible, user-operated fasteners which secure the helmet's layers produces distinct advantages over previous attempts in helmet design. Other attempts have relied upon externally-exposed fasteners with deformable materials as the primary fastening mechanism, often requiring additional features for security. These attempts are of detriment to aesthetics, as the fastening mechanisms are visible during use, to security, as the fasteners are exposed on the helmet's exterior and do not accommodate deformation during impact, and to efficiency, since the user must forcibly bend the structure to operate the fasteners. The current invention solves all of these issues, and provides an engineered design to overcome the previously intractable problem of designing an interchangeable helmet which is safe, efficient, and aesthetically appealing.

The foregoing merely illustrates the principles of the invention. For example, although the outer shell of the illustrative embodiment comprises two simple pieces, other shapes, configurations, numbers of segments, ventilation patterns, and anchoring systems are possible. It will thus be appreciated that those skilled in the art will be able to devise numerous alternative arrangements that, while not shown or described herein, embody the principles of the invention and thus are within its spirit and scope. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A helmet system comprising:

a one-piece force-absorbing element having a concave inner surface and a convex outer surface;

a rigid shell having a concave inner surface opposite and facing said convex outer surface of said force-absorbing element;

a plurality of fastener receptacles arranged on one of said convex outer surface of said force-absorbing element and said inner surface of said rigid shell, each fastener receptacle having a prearranged engagement member therein and an open receiving end facing a respective point of contact on the other of said convex outer surface of said force-absorbing element and said inner surface of said rigid shell; and a plurality of fastening devices, each of said plurality of fastening devices:

arranged at one of said points of contact, comprising an engaging member configured to cooperate with a respective engagement member to hold the respective fastening device within the respective fastening receptacle, and configured to couple to a respective one of said receptacles to removably fasten said force-absorbing element to said rigid shell.

2. The helmet system of claim 1, wherein said fastening devices extend inwardly from said inner surface of said rigid shell to engage said fastener receptacles of said force-absorbing element.

3. The helmet system of claim 1, wherein said fastening devices extend outward from said outer surface of said force-absorbing element and engage said fastener receptacles of said rigid shell.

4. The helmet system of claim 2, wherein said fastening devices pass into said force-absorbing element.

5. The helmet system of claim 1, wherein said fastening devices and said fastener receptacles are not visibly exposed during use.

6. The helmet system of claim 1, wherein said fastening devices are accessible from the concave inner surface of said force-absorbing element.

7. The helmet system of claim 1, wherein each of said engagement members is positioned within a respective one of said plurality of fastener receptacles and upon insertion of each respective fastening device of the plurality of fastening devices into the respective fastener receptacle of said plurality of fastener receptacles the respective fastener receptacle loads and locks the respective fastening device thereby preventing radial separation of said rigid shell and said force-absorbing element.

8. The helmet system of claim 1, wherein an entirety of the inner surface of the rigid shell has a shape that conforms to a shape of corresponding portions of said convex outer surface of the force-absorbing element.

9. The helmet system of claim 8, wherein the conforming shapes of the inner surface of the rigid shell and the outer surface of the force-absorbing element allow the plurality of fastener receptacles to align respectively with the plurality of fastening devices when the inner surface of the rigid shell receives the outer surface of the force-absorbing element.

10. The helmet of claim 9, wherein the alignment of the plurality of fastener receptacles with the plurality of fastening devices allows engagement of each engaging member with a respective engagement member.

11. The helmet of claim 10, wherein the alignment of the plurality of fastener receptacles with the plurality of fastening devices allows subsequent engagement of each engaging member with a respective engagement member.

12. A helmet system comprising:

a one-piece force-absorbing element having a concave inner surface, a convex outer surface, and a plurality of fastener receptacles within embedded in said force-absorbing element open at said convex outer surface of said force-absorbing element and defining a plurality of attachment points; and a rigid shell having a convex outer surface, a concave inner surface opposite the convex outer surface of the force-absorbing element, and a plurality of inwardly extending engaging means, each corresponding with a respective one of said plurality of attachment points and extending between said outer surface of said force-absorbing element and said inner surface of said rigid shell for engaging said force-absorbing element with said rigid shell upon insertion into said respective receptacle at the respective attachment point, each fastener receptacle comprising therein a member maintained in a first configuration pre-assembly and in a second configuration upon locking insertion of a corresponding engaging means that removably attaches said rigid shell to said force-absorbing element at a plurality of locations thereby preventing the separation of said shell and said force-absorbing element.

13. The helmet system of claim 12, wherein said engaging means for removably fastening comprise a plurality of fasteners extending between said rigid shell and said force-absorbing element.

14. The helmet system of claim 12, wherein said engaging means for removably fastening are not visibly exposed during use.

15. The helmet system of claim 12, wherein said fastener receptacles within said force-absorbing element are operable from the concave inner surface of said force-absorbing element to release said engaging means.

16. The helmet system of claim 12, wherein said member includes a preloaded spring which loads said engaging means under tension preventing radial separation of said rigid shell from said force-absorbing element.

17. The helmet system of claim 12, wherein an entirety of the inner surface of the rigid shell has a shape that conforms to a shape of corresponding portions of said convex outer surface of the force-absorbing element.

18. The helmet system of claim 17, wherein the conforming shapes of the inner surface of the rigid shell and the outer surface of the force-absorbing element allow the plurality of fastener receptacles to align respectively with the plurality of fastening devices when the inner surface of the rigid shell receives the outer surface of the force-absorbing element.

19. The helmet of claim 18, wherein the alignment of the plurality of fastener receptacles with the plurality of fastening devices allows engagement of each engaging member with a respective engagement member.

20. The helmet of claim 19, wherein the alignment of the plurality of fastener receptacles with the plurality of fastening devices allows subsequent engagement of each engaging member with a respective engagement member.

* * * * *